US010475427B2

(12) United States Patent
Kodama et al.

(10) Patent No.: US 10,475,427 B2
(45) Date of Patent: Nov. 12, 2019

(54) OPERATION STATE DETECTING APPARATUS, OPERATION STATE DETECTING SHEET, AND ELECTRONIC INSTRUMENT

(71) Applicant: CASIO COMPUTER CO., LTD., Tokyo (JP)

(72) Inventors: Masahiko Kodama, Ome (JP); Takashi Soda, Hamura (JP); Hiroyuki Tanabe, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/230,049

(22) Filed: Dec. 21, 2018

(65) Prior Publication Data

US 2019/0197999 A1 Jun. 27, 2019

(30) Foreign Application Priority Data

Dec. 25, 2017 (JP) ..... 2017-247206

(51) Int. Cl.
*G10H 1/00* (2006.01)
*G10H 1/34* (2006.01)

(52) U.S. Cl.
CPC ..... *G10H 1/0008* (2013.01); *G10H 1/34* (2013.01); *G10H 2220/096* (2013.01); *G10H 2220/221* (2013.01)

(58) Field of Classification Search
CPC ..... G10H 1/0008
USPC ..... 84/609
See application file for complete search history.

(56) References Cited

U.S. PATENT DOCUMENTS 3,795,989 A * 3/1974 Greenberg ..... G09B 7/06 434/339
4,852,443 A * 8/1989 Duncan ..... G10H 1/0551 84/733
8,450,628 B2 * 5/2013 Yau ..... G06F 3/044 200/600
8,476,519 B2 * 7/2013 Liotta ..... H04R 1/1033 2/90

(Continued)

FOREIGN PATENT DOCUMENTS

JP 2006-085286 A 3/2006
JP 2009-134473 A 6/2009
JP 2012-037856 A 2/2012

*Primary Examiner* — David S Warren
(74) *Attorney, Agent, or Firm* — Fitch, Even, Tabin & Flannery LLP

(57) ABSTRACT

An operation state detecting apparatus includes the following. An electronic device includes an operation surface and can detect whether there is contact in a plurality of positions. A sheet material can be attached to and detached from the operation surface. The sheet material includes a projecting portion which deforms to change a contact state on the operation surface according to strength of external force. A processor of the electronic device detects whether there is contact in a plurality of positions in an individual detecting region on the operation surface on which a contact state changes by the projecting portion deforming in a state with the sheet material attached to the operation surface. The processor performs a specific process according to strength or speed of an operation applied to the projecting portion judged based on a detected result of whether contact is detected in the plurality of positions.

12 Claims, 7 Drawing Sheets

(56) References Cited

U.S. PATENT DOCUMENTS 8,507,782 B2 * 8/2013 Takehisa ..... G10H 1/0066 84/626
8,729,379 B2 * 5/2014 Wallace ..... G10D 13/024 84/733
8,891,222 B2 * 11/2014 Benslimane ..... H01G 5/16 361/273
8,904,876 B2 * 12/2014 Taylor ..... G01L 1/18 361/283.4
9,075,404 B2 * 7/2015 McMillen ..... G10H 1/348
9,076,419 B2 * 7/2015 McMillen ..... G10H 1/02
9,442,614 B2 * 9/2016 McMillen ..... G06F 3/044
9,453,774 B2 * 9/2016 Bao ..... G01L 7/041
9,546,921 B2 * 1/2017 McMillen ..... G10H 1/348
9,583,087 B2 * 2/2017 Iwase ..... G10H 1/344
9,721,552 B2 * 8/2017 Mizrahi ..... G10H 1/348
9,752,940 B2 * 9/2017 Ogura ..... G01L 1/142
9,753,568 B2 * 9/2017 McMillen ..... G06F 1/16
9,779,709 B2 * 10/2017 Linn ..... G10H 1/0066
9,836,151 B2 * 12/2017 McMillen ..... G10H 1/02
9,965,076 B2 * 5/2018 McMillen ..... G06F 1/163
9,966,952 B2 * 5/2018 Okada ..... H03K 17/975
10,078,027 B2 * 9/2018 Masuda ..... G01L 9/0073
10,114,493 B2 * 10/2018 McMillen ..... G10H 1/02
2005/0045024 A1 * 3/2005 Sagastegui ..... G09B 15/00 84/470 R
2006/0123982 A1 * 6/2006 Christensen ..... G10H 1/0066 84/723
2006/0144211 A1 * 7/2006 Yoshimoto ..... G06F 3/0234 84/615
2008/0115653 A1 * 5/2008 Sagastegui ..... G09B 15/00 84/465
2010/0319519 A1 * 12/2010 Takehisa ..... G10H 1/0066 84/723
2011/0088536 A1 * 4/2011 McMillen ..... G10H 1/348 84/746
2011/0100198 A1 * 5/2011 Gatzsche ..... G10H 1/0008 84/615
2012/0144981 A1 * 6/2012 Ciccone ..... G01D 5/2417 84/746
2013/0239787 A1 * 9/2013 McMillen ..... G10H 1/02 84/643
2014/0222243 A1 * 8/2014 McMillen ..... G10H 1/348 700/301
2015/0261372 A1 * 9/2015 McMillen ..... G10H 1/02 345/174
2015/0316434 A1 * 11/2015 McMillen ..... G10H 1/348 345/174
2015/0317964 A1 * 11/2015 McMillen ..... G10H 1/02 84/730
2016/0224236 A1 * 8/2016 Ludwig ..... G10H 1/00
2017/0046121 A1 * 2/2017 Lee ..... G06F 3/165
2017/0047082 A1 * 2/2017 Lee ..... G10H 1/0008
2017/0109127 A1 * 4/2017 Osborn ..... G10H 1/0058
2017/0167931 A1 * 6/2017 McMillen ..... G10H 1/348
2018/0107370 A1 * 4/2018 Ludwig ..... G10H 1/00
2018/0137847 A1 * 5/2018 Borman ..... G10H 3/146
2019/0034019 A1 * 1/2019 McMillen ..... G10H 1/00

* cited by examiner

OPERATION STATE DETECTING APPARATUS, OPERATION STATE DETECTING SHEET, AND ELECTRONIC INSTRUMENT

CROSS-REFERENCE TO RELATED APPLICATIONS

This application is based upon and claims the benefit of priority from the prior Japanese Patent Application No. 2017-247206, filed on Dec. 25, 2017, the entire contents of which are incorporated herein by reference.

BACKGROUND OF THE INVENTION

1. Field of the Invention

The present invention relates to an operation state detecting apparatus which detects an operating state such as strength and speed of operation, an operation state detecting sheet, and an electronic instrument.

2. Description of the Related Art

Conventionally, there is a well-known application program in which an image simulating an acoustic instrument is displayed on a display of a portable terminal device, etc. provided with a touch panel and a user touches the touch panel to enable the user to play an imitation instrument.

When such program is used, even if the user does not own a drum set, the user can easily enjoy playing drums using the portable terminal apparatus.

However, although by using such touch panel provided in the electronic device such as a normal portable terminal apparatus, etc. it is possible to detect whether the touch panel is touched and the touched position on the touch panel, it is not possible to detect the strength and the speed that the touch panel is hit (pressed). Therefore, the sound output is the same regardless of how the touch panel is hit, and it is not possible to obtain the feel of playing an acoustic instrument (such as a drum) in which the degree of the sound changes depending on how hard and fast the instrument is hit.

Moreover, such touch panel does not have an uneven surface. Therefore, when an imitation instrument is played, the user needs to play the instrument while confirming the position to be touched on the display by sight. From this point also, the feel of playing the instrument is different from the acoustic instrument which can be played by confirming with the hands the position of the instrument and the position to be hit without looking.

Regarding this point, Japanese Patent Application Laid-Open Publication No. 2012-37856 discloses an operation input apparatus of an electronic percussion instrument which is provided with a plurality of elastic hitting pads on a membrane sheet and which is configured to play sound material associated to each hitting pad when the user hits the hitting pad.

According to such technique, a touch panel and a detecting circuit are provided for the electronic percussion instrument in advance. Therefore, the change in the contact square area of the electrode which changes according to the strength of the hit applied to the hitting pad can be detected as the strength of the hit, and output can be performed according to the above.

SUMMARY OF THE INVENTION

According to an aspect of the present invention, there is an operation state detecting apparatus including: an electronic device which includes an operation surface and which can detect whether there is contact by operation in a plurality of positions on the operation surface; and a sheet material which can be attached to and detached from the operation surface of the electronic device, wherein, the sheet material includes a projecting portion which deforms to change a contact state on the operation surface according to strength of external force applied in a state with the sheet material attached to the operation surface, and a processor of the electronic device detects whether there is contact in a plurality of positions in an individual detecting region on the operation surface on which a contact state changes by the projecting portion deforming in a state with the sheet material attached to the operation surface, and the processor performs a specific process according to strength or speed of an operation applied to the projecting portion judged based on a detected result of whether contact is detected in the plurality of positions.

According to another aspect of the present invention, there is an operation state detecting sheet which is a sheet material which can be attached to and detached from an operation surface of an electronic device which includes the operation surface, which detects whether there is contact in a plurality of positions in an individual detecting region provided on the operation surface and which is able to judge strength or speed of operation applied to a portion corresponding to the individual detecting region of the operation surface based on a detecting result of the contact detected in the plurality of positions, the sheet including: a projecting portion which is provided in a position corresponding to the individual detecting region, wherein, the projecting portion deforms to change a contact state on the plurality of positions in the individual detecting region according to the strength of external force applied to the projecting portion in a state with the operation detecting sheet attached to the operation surface.

According to another aspect of the present invention, there is an electronic instrument including: the operation state detecting apparatus according to claim 1, wherein the electronic device controls output of sound according to the strength or the speed of the operation on the operation surface detected by the individual detecting region.

DETAILED DESCRIPTION OF THE PREFERRED EMBODIMENTS

An embodiment of an operation input system according to the present invention and an embodiment of a pad sheet (sheet member) included in the operation input system is described with reference to FIG. 1 to FIG. 14. Various technical limitations are applied to the present embodiment in order to implement the present invention but the scope of the present invention is not limited by the embodiments and the illustrated examples described below.

<Entire Configuration>

Figure 1:
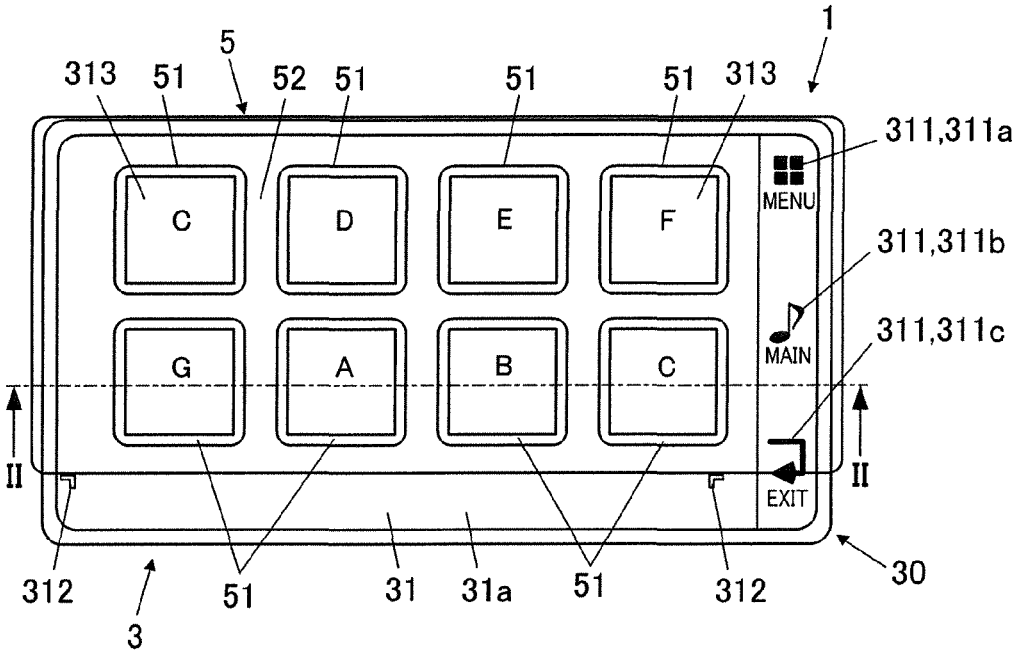
FIG. 1 is a plan view showing an example of an operation input system according to the present embodiment.
Figure 2:
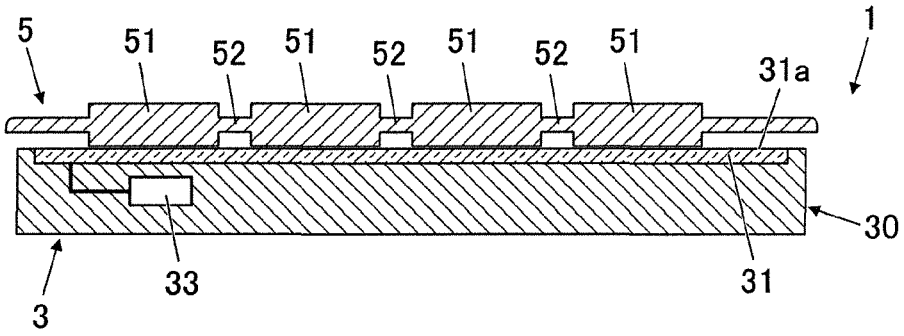
FIG. 2 is a cross-sectional view of a main section of an operation input system along line II-II shown in FIG. 1.

FIG. 1 is a plan view showing an example of an operation/input system according to the present embodiment. FIG. 2 is a schematic cross-sectional view showing a main section of the operation input system along line II-II shown in FIG. 1.

As shown in FIG. 1 and FIG. 2, the operation input system 1 according to the present embodiment is provided with an electronic device 3 provided with an operation surface 31, and a pad sheet 5 provided on a front surface of the operation surface 31 of the electronic device 3.

Figure 3:
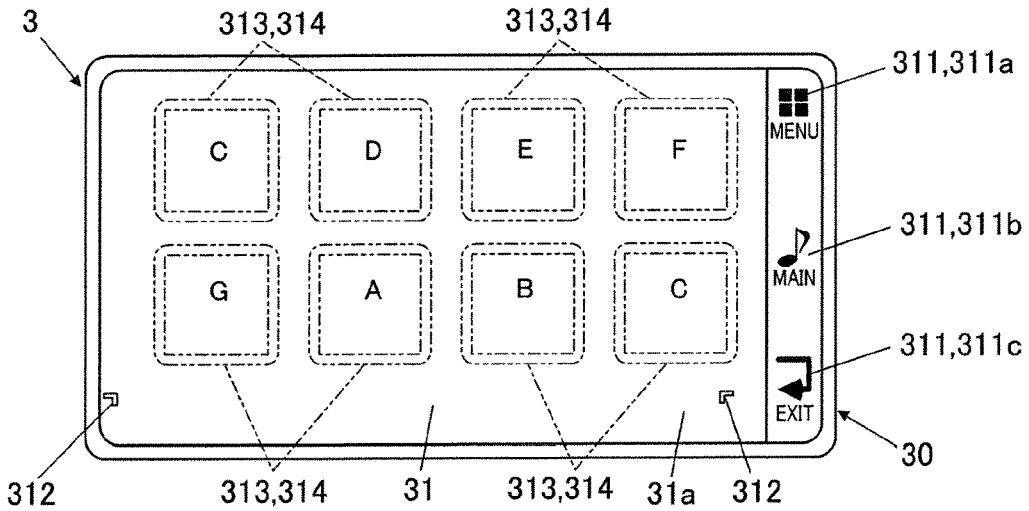
FIG. 3 is a plan view showing an example of an electronic apparatus according to the present embodiment.
Figure 4A:
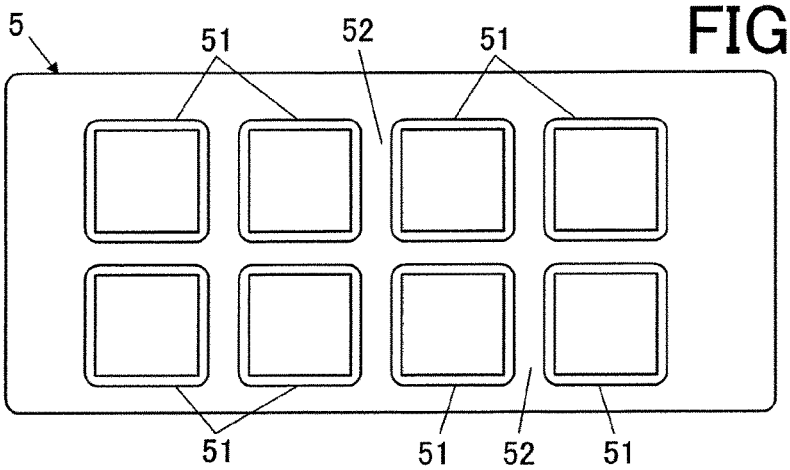
FIG. 4A is a plan view viewing a pad sheet according to the present embodiment from a front surface side.
Figure 4B:
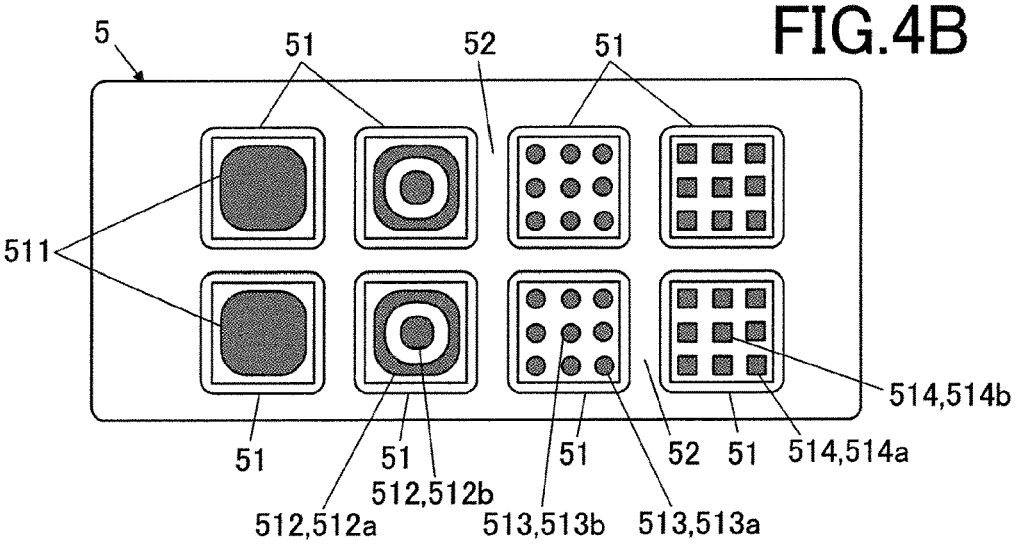
FIG. 4B is a plan view viewing a pad sheet according to the present embodiment from a rear surface side.

FIG. 3 is a plan view showing an example of an electronic device according to the present embodiment, FIG. 4A is a plan view viewing the pad sheet from the front surface side (upper side in FIG. 2) and FIG. 4B is a plan view viewing the pad sheet from the back surface side (lower side in FIG. 2).

As shown in FIG. 1, etc., according to the present embodiment, the pad sheet 5 is made to be a size smaller than the operation surface 31 of the electronic device 3, and the portion where the pad sheet 5 is not provided can be used as the normal operation surface 31 (that is, the touch panel as described later). The position and the range where the pad sheet 5 is provided are simply examples, and the above is not limited to the illustrated examples.

«Configuration of Electronic Device»

As shown in FIG. 1 to FIG. 3, the electronic device 3 according to the present embodiment includes an operation surface 31 on which the pad sheet 5 is provided on the front surface and an operation detector 31*a* which outputs the operation signal according to whether the operation surface 31 is touched and according to the change in the contact state.

For example, a tablet terminal apparatus or a portable terminal apparatus such as a smartphone, an operating panel apparatus provided in an electronic instrument such as an electronic piano or a keyboard are to be used as the electronic device 3.

The electronic device 3 included in the operating input system 1 is not limited to the illustrated examples. The electronic device 3 is to include the operation surface 31 and the operation detector 31*a*, and a wide variety of various devices can be applied.

As shown in FIG. 2, the operation surface 31 is provided on the front surface side of a case 30 of the electronic device 3. The operation surface 31 is a display panel including a display such as a Liquid Crystal Display (LCD), an organic electroluminescence display, or any other flat display. According to the present embodiment, a position input apparatus (operation detector 31*a*) such as a touch pad to perform various input is configured as one on the operation surface 31 as the display panel. With this, the touch panel is made.

When the finger touches the front surface of the operation surface 31, the operation detector 31*a* outputs the operation signal according to whether the operation surface 31 is touched and the change in the contact state.

When a later-described pad portion 51 (contact convex portion 511, etc. of the pad portion 51) is in contact with the operation surface 31, the operation detector 31*a* according to the present embodiment detects the contact state of the pad portion 51 (projecting portion) to the operation surface 31 such as the range of the contact portion, the number of contact portions, and the contact timing, and the operation signal is output according to the above.

Figure 14:
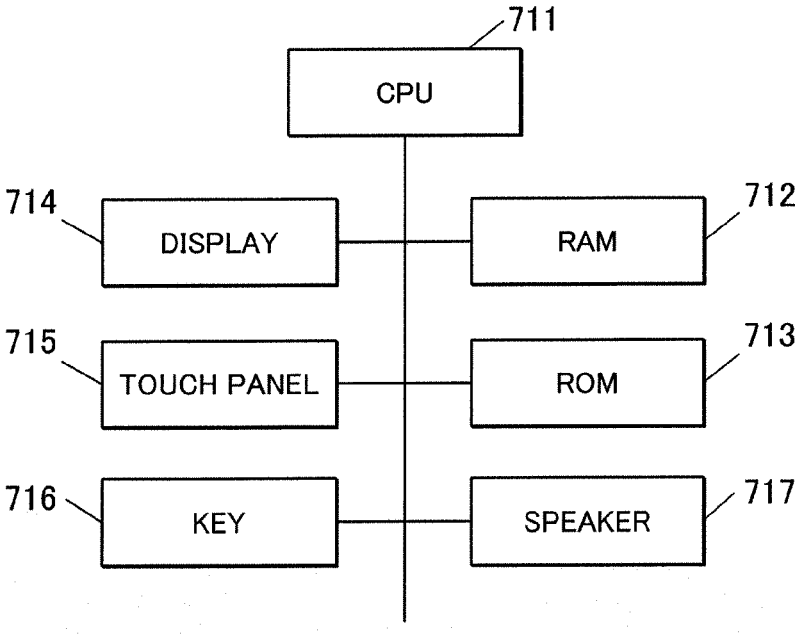
FIG. 14 is a system configuration of the electronic device according to the present embodiment.

The operation signal output from the operation detector 31*a* is received on the control apparatus 33 of the electronic device 3. For example, as shown in FIG. 14, the control apparatus 33 is a computer including, for example, a CPU 711 (processor), a ROM 713, a RAM 712, a display 714, a touch panel 715, a key 716 (operation button), and a speaker 717 (or a sound output unit including various audio terminals), and sound according to the operation signal output from the operation detector 31*a* can be output from the speaker 717 (or various audio terminals) when the CPU 711 executes a control program stored in the ROM 713 or the RAM 712.

According to the present embodiment, the operation surface 31 includes a pressure sensitive type (resistive film type) touch panel 715 together with the operation detector 31*a* provided with the resistive film (not shown).

The touch panel 715 including the pressure sensitive type (resistive film type) operation detector 31*a* is provided with a film on the front of the display panel such as the LCD so as to sense pressure, and when external force is applied to the film, the portion on which pressure is applied is detected.

The method of detection by the touch panel as the operation surface 31 is not limited, and a type other than the pressure sensitive type can be applied.

For example, the touch panel provided with a capacitance type operation detector 31*a* can be applied as the operation surface 31. The capacitance type touch panel detects the position by catching the change of the capacitance between the finger, etc. and the conductive film. Since the capacitance type touch panel detects the change in the capacitance, when the capacitance type touch panel is used as the operation surface 31, it is necessary to use material which includes conductivity to be able to make a detection with the conductive film as the material to form the later-described pad sheet 5.

The touch panel provided with the operation detector 31*a* is preferably a multi-touch format touch panel. In this case, a plurality of pad portions 51 being pressed at the same time and the strength that the pad portion 51 is pressed can be recognized. With this, the resolution with a few bits can be included and a more detailed control is possible.

Various messages and operation buttons 311 can be displayed on the operation surface 31.

The electronic device 3 according to the present embodiment (see control apparatus 33 of the electronic device 3, FIG. 2) is able to display a playing mode screen as shown in FIG. 1 or FIG. 3 on the operation surface 31 by starting the dedicated program (application program). With this, a playing mode can be executed by playing the electronic device 3 as an imitation instrument.

In such playing mode, for example, as shown in FIG. 1 and FIG. 3, various operation buttons 311 are displayed in an edge of the operation surface 31.

In FIG. 1 and FIG. 3, a menu button 311*a* in which various menus can be selected while performing the playing mode (for example, practice mode in which the user is navigated while playing), a main selection button 311*b* in which various selections regarding playing can be made (selection of type of instrument played as the simulated instrument), and an end button 311*c* to end the playing mode are displayed. The user is able to input various instructions in the playing mode by operating these operation buttons 311.

During the playing mode, a positioning index 312 which is an index for positioning the pad sheet 5 can be displayed on the operation surface 31.

The positioning index 312 is to be a mark to perform positioning when the pad sheet 5 is attached to the electronic device 3 so that the region (plurality of individual detecting regions 314) on the pad sheet 5 in which the contact state on the operation surface 31 changes by providing the pad portion 51 overlaps with the region (plurality of individual detecting regions 314) on the operation surface 31 in which the operation detector 31*a* detects the contact state on the operation surface 31.

The positioning index 312 is to be able to show the position reference when the user provides the pad sheet 5 on the operation surface 31 and the shape is not limited.

Alternatively, an adjustment unit can be provided. The operation detector 31*a* detects the provided state of the pad sheet 5 (position and direction of the pad sheet 5). Then, the positions of the regions are adjusted so that the position of an individual detecting region 314 (that is, plurality of regions on the operation surface 31 in which the operation detector 31*a* is able to individually detect the contact state) in the operation surface 31 corresponds to the positions of the plurality of pad portions 51 provided on the pad sheet 5.

According to such configuration, even if the positioning index 312 is not displayed or the pad sheet 5 is provided without considering the positioning index 312, the operation detector 31*a* detects the provided state of the pad sheet 5, and the operation detector 31*a* is able to suitably detect the contact state to the operation surface 31 of the pad portion 51 by suitably adjusting the position of the individual detecting region 314 on the operation surface 31.

Preferably, during the playing mode, the portion in which the pad portion 51 (later described, see FIG. 4A and FIG. 4B) of the pad sheet 5 is provided on the operation surface 31 is displayed with a display corresponding to each pad portion 51.

For example, FIG. 1 and FIG. 3 each shows a frame (for example, displayed with a two-dot chain line in FIG. 3) corresponding to the pad portion 51 or a pad index 313 such as a character or a figure corresponding to the pad portion 51 is displayed in the position corresponding to the pad portion 51 when the pad sheet 5 is provided on the operation surface 31. Each region displaying the pad index 313 matches with the region (position and size) of the individual detecting region 314 provided on the operation surface 31 (the sizes of the individual detecting region 314 and the pad index 313 do not always have to match).

It is not necessary to display the pad index 313. The contents displayed as the pad index 313 are not limited to the contents illustrated in the drawings.

For example, the pad index 313 can show only a frame as a guide showing the position of the pad portions 51 when the pad sheet 5 is provided. Alternatively, only the function assigned to each pad portion 51 may be displayed without the display of the frame. For example, in FIG. 1 and FIG. 3, when the function assigned to each pad portion 51 is a "musical scale", the alphabets "CDEFGABC" corresponding to "Do" to another "Do" one octave above are displayed in the positions corresponding to the pad portions 51 as the pad index 313.

Other than a musical scale as described above, different types of instruments and sounds are assumed as the function assigned to each pad portion 51. In this case, the instrument such as a drum, a flute or various types of percussion (tambourine, cowbell, etc.) can be shown with the name in characters or with illustrations on the operation surface 31 as the pad index 313. Alternatively, a geometric pattern can be shown as the pad index 313 without relation to instruments. Further, a call of different animals can be emitted from each pad portion 51, and in this case, the name in characters or the illustration of the animal can be displayed as the pad index 313.

«Configuration of Pad Sheet»

The pad sheet 5 is provided on the operation surface 31 of the electronic device 3. Preferably, at least the back surface side of the pad sheet 5 smoothly fits when the pad sheet 5 is provided on the operation surface 31, and resin with a certain degree of flexibility such as silicone rubber is applied.

The material forming the pad sheet 5 is not limited to silicone rubber. For example, various types of elastomer material such as natural rubber, urethane rubber, isoprene rubber, and nitrile rubber (NBR) can be used.

The pad sheet 5 is formed by molding as one using the resin material such as silicone rubber. It is not necessary to mold the pad sheet as one with one material, and the pad sheet 5 can be formed by units formed from different materials pasted to each other in a shape of a sheet.

For example, when the above-described operation surface 31 is a touch panel provided with an electrostatic capacitance type operation detector 31*a*, the material needs to have conductivity in order for the operation detector 31*a* to be able to detect the touch on the operation surface 31. Regarding this point, only the portion of the operation surface 31 which is touched needs to be formed from material including conductivity. Therefore, for example, the material of the pad sheet 5 can be different between the front surface side and the back surface side which comes into contact with the operation surface 31, and only the back surface side may be formed from material having conductivity. Alternatively, only an edge surface (contact surface with the operation surface 31) of the contact convex portion 511, etc. (later described, see FIG. 4B, FIG. 7) which is the portion of the back surface side of the pad sheet 5 that comes into contact with the operation surface 31 may be formed from material including conductivity.

It is more preferable that the front surface side of the pad sheet 5 has a feel closer to touching the instrument played as a simulation using the pad sheet so that the player (user) can have a feeling of actually playing the instrument.

For example, therefore, when the operation portion is hard to a certain degree such as when the simulated instrument is a piano (the operation portion is a keyboard in a piano) a resin with a certain degree of hardness such as ABS resin is used on the front surface side of the pad sheet 5, and a silicone rubber which can be deformed flexibly is used on the back surface side of the pad sheet 5. That is, the back sheet 5 can be formed by attaching units formed from different material.

Preferably, the pad sheet 5 is formed from a material which is transparent or translucent.

When the pad sheet 5 is formed from a transparent or translucent material and it is possible to see what is provided below (operation surface 31 of the electronic device 3 in FIG. 1), the user is able to easily understand the functions of each pad portion 51 by displaying the characters and illustrations showing the scale and the type of instrument as the pad index 313 on the operation surface 31 of the electronic device 3, as described above. By displaying various types of display with color on the operation surface 31, the colorful expression can be enjoyed through the pad sheet 5.

When the pad sheet 5 is formed from a material through which what is provided is difficult to see, the necessity to display the pad index 313 on the operation surface 31 of the electronic device 3 is low. In this case, instead of displaying the pad index 313 on the operation surface 31, or together with the display of the pad index 313, characters and illustrations showing the functions corresponding to each pad portion 51 can be shown by printing on the front surface of the pad sheet 5. Alternatively, concave and convex portions showing the function corresponding to each pad portion 51 can be formed on the front surface of the pad sheet 5 (for example, a drum shape raised three-dimensionally from the surface).

The pad sheet 5 is made in a deformable state and includes the pad portion 51 positioned on the operation surface 31 of the electronic device 3.

FIG. 4A shows the pad sheet 5 provided with eight pad portions 51 in a substantial square shape. The number, shape, and position of the pad portions 51 are not limited to the example shown in FIG. 4A.

Figure 5:
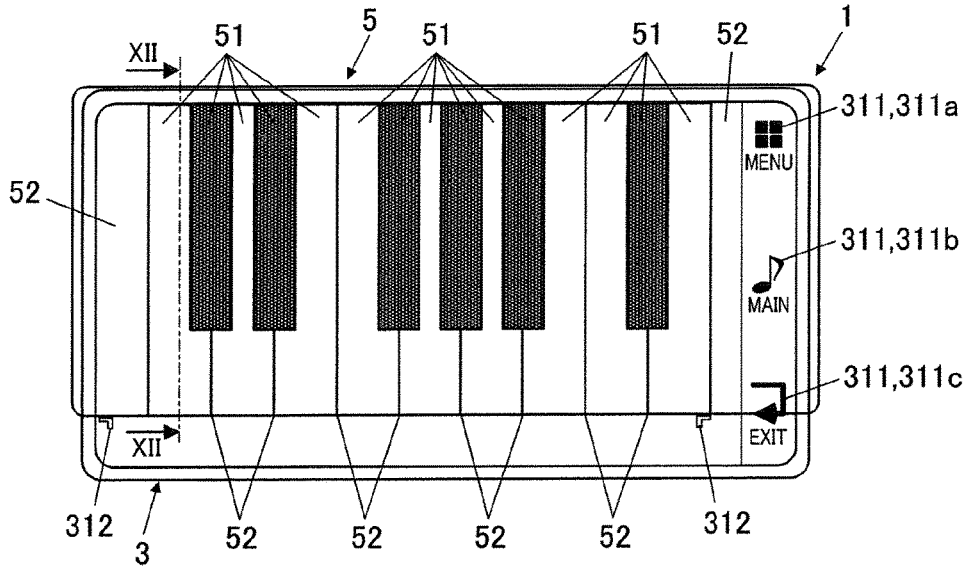
FIG. 5 is a plan view showing an example of an operation input system when a simulated instrument played by a user is a piano.
Figure 6:
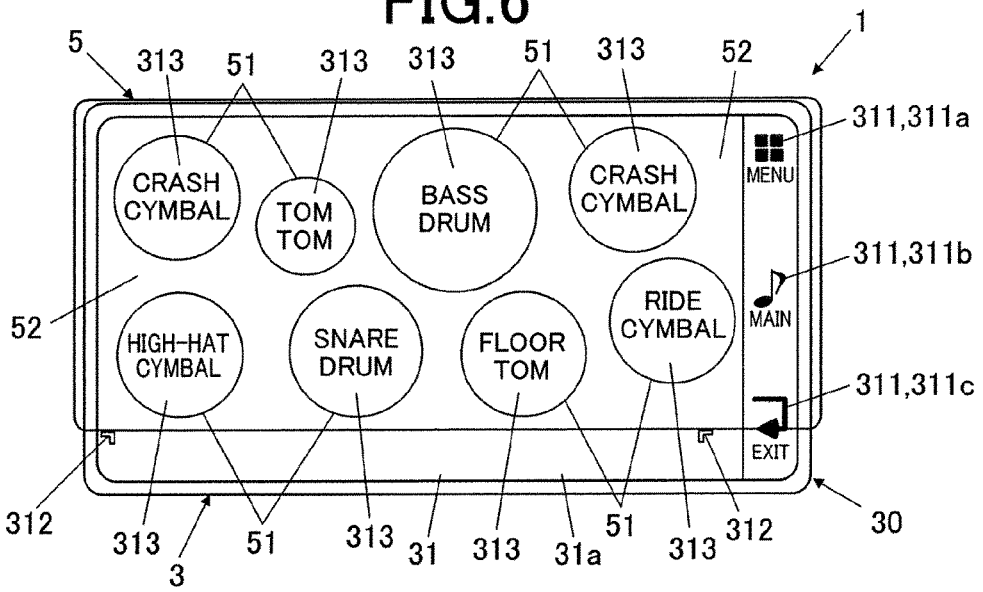
FIG. 6 is a plan view showing an example of an operation input system when a simulated instrument played by a user is a drum.

For example, when the simulated instrument played by the user is the piano, as shown in FIG. 5, a pad portion 51 similar to a keyboard of a piano can be provided on the pad sheet 5. When the simulated instrument played by the user is a drum, as shown in FIG. 6, a pad portion 51 each shaped in a round shape and positioned like a drum set can be provided on the pad sheet 5.

Preferably, a plurality of pad sheets 5 including pad portions 51 in various shapes are prepared so that the pad sheets 5 can be replaced on the electronic device 3. In this case, for example, when the pad sheet 5 as shown in FIG. 1 is provided, playing an xylophone or marimba can be simulated, when the pad sheet 5 as shown in FIG. 5 is provided, playing a piano can be simulated, and when the pad sheet 5 as shown in FIG. 6 is provided, playing a drum can be simulated. The user can enjoy a simulation of playing various instruments with one electronic device 3 by changing the pad sheet 5.

The pad portion 51 is deformed when external force is applied, and the contact state with the operation surface 31 can be changed according to the strength of the external force (the speed and energy that the external force is applied can be considered in the "strength" described hereinbelow).

That is, when the pad portion 51 is hit or pressed from the front surface side (upper side in FIG. 2) with the finger and external force is applied, the rear surface side (lower side in FIG. 2) of the pad portion 51 touches the operation surface 31 according to the external force.

In the present embodiment "contact state" of the pad portion 51 to the operation surface 31 means the range of the contact portion, the number of contact portions and the contact timing that the pad portion 51 is in contact with the operation surface 31. Items other than the above can be considered as the "contact state".

According to the present embodiment, a plurality of regions (individual detecting region 314) with which the operation detector 31*a* can individually detect a contact state can be provided on an operation surface 31 on which the pad sheet 5 is positioned.

When the pad sheet 5 is provided on the operation surface 31, the plurality of pad portions 51 are provided so that the position and size of the portion in which the contact state to the operation surface 31 changes individually corresponds to the position and the size of the individual detecting region 314 on the operation surface 31. With this, the contact state on the operation surface 31 of each pad portion 51 can be suitably detected by the operation detector 31*a*.

Various configurations of the pad portion 51 can be considered and the shape of the pad portion 51 is suitably selected according to the type of instrument that is simulated.

For example, among the pad portions shown in FIG. 4B, the two pad portions 51 in the left edge are to include one contact convex portion 511 in which the entire rear surface side of the pad portion 51 is projected toward the operation surface 31.

Among the pad portions 51 shown in FIG. 4B, the two pad portions 51 in the second row from the left include two contact convex portions 512*a* formed on the rear surface side of the pad portion 51 so as to project toward the operation surface 31. The contact convex portion 512 includes a first contact convex portion 512*a* formed in a ring shape on the rear surface side of the pad portion 51 and a second contact convex portion 512*b* formed provided in substantially the center portion of the first contact convex portion 512*a*. As described later, according to the present invention, the height (length) of the first contact convex portion 512*a* is higher (longer) than the second contact convex portion 512*b*.

Among the pad portions 51 shown in FIG. 4B, the two pad portions 51 in the third row from the left include nine contact convex portions 513 in a substantial cylinder shape projecting toward the operation surface 31 are formed on the rear surface side of the pad portion 51. The contact convex portion 513 includes eight first contact convex portions 513*a* provided along an outer circumferential of the rear surface side of the pad portion 51, and a second contact convex portion 513*b* provided in substantially the center portion of the first contact convex portion 513*a*. As described later, according to the present invention, the height (length) of the first contact convex portion 513*a* is higher (longer) than the second contact convex portion 513*b* in the projecting direction.

Among the pad portions 51 shown in FIG. 4B, the two pad portions 51 in the right edge include nine contact convex portions 514 formed in a rectangular prism shape on the rear surface side of the pad portion 51 so as to project toward the operation surface 31. The contact convex portion 514 includes eight first contact convex portions 514*a* provided along an outer circumference on the rear surface side of the pad portion 51 and a second contact convex portion 514*b* provided in the substantial center portion of the first contact convex portion 514*a*. As described later, according to the present invention, the height (length) of the first contact convex portion 514*a* is higher (longer) than the second contact convex portion 514*b* in the projecting direction.

The configuration of the pad portion 51 shown in FIG. 4B is one example.

In one pad sheet 5, all of the pad portions 51 may have the same configuration, and the contact convex portion with the same configuration can be provided. As shown in FIG. 4B, pad portions 51 including various contact convex portions can be mixed in one pad sheet 5.

For example, as shown in FIG. 7A to FIG. 7D, the pad portion 51 can be a circular shape. When the simulated instrument is a drum (for example, see FIG. 6), the feeling becomes nearer to the real instrument when the pad portion 51 is the circular shape.

The size and the shape of the pad portion 51 provided in one pad sheet 5 do not have to be the same, and the pad portion 51 in a rectangular shape shown in FIG. 4B and the pad portion 51 in a circular shape shown in FIG. 6 can be mixed in the pad sheet 5. Further, as shown in FIG. 6, pad portions 51 with various sizes can be mixed in one pad sheet 5.

Various variations are possible for the array of the contact convex portion 511.

Figures 7A, 7B, 7C, 7D:
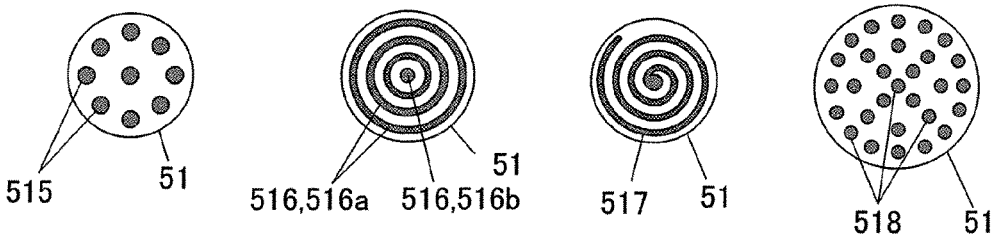
FIG. 7A is a plan view showing an example of a contact convex portion of a pad portion.
FIG. 7B is a plan view showing an example of a contact convex portion of a pad portion.
FIG. 7C is a plan view showing an example of a contact convex portion of a pad portion.
FIG. 7D is a plan view showing an example of a contact convex portion of a pad portion.

For example, as shown in FIG. 7A, one contact convex portion 515 in a substantial cylinder shape may be provided in substantially the center of the pad portion 51, and a plurality of contact convex portions 515 can be provided to surround such contact convex portion 515. In this case, the height (length) of all of the contact convex portions 515 in the projecting direction can be the same, or the height may be changed to two or more steps depending on the position.

For example, as shown in FIG. 7B, one contact convex portion 516 (516*a*) in a substantial cylindrical shape may be provided in a substantial center of the pad portion 51 and a plurality of contact convex portions 516 (516*b*) may be concentrically provided in a ring shape to surround the contact convex portion 516*a*. In this case, the height (length) of the contact convex portion 516*a* and the contact convex portion 516*b* can be the same in the projecting direction, and the height can be changed in two steps or more depending on the position. The contact convex portions 516*b* can be provided in a substantially same interval or can be provided shifted from the interval.

Further, as shown in FIG. 7C, a contact convex portion 517 can be provided in a spiral shape in one connection from the surrounding edge of the pad portion 51 to the center portion. In this case, the height (length) of the contact convex portion 517 in the projection direction can be the same or can be changed to two or more steps.

For example, as shown in FIG. 7D, a larger number of contact convex portions 518 can be provided on the entire back surface side of the pad portion 51. In this case, the contact convex portions 518 can be provided in substantially even intervals or randomly. The height (length) of all of the contact convex portions 518 in the projecting direction can be the same or the height can be changed to two or more steps depending on the position.

The number of contact convex portions 518 provided in the pad portion 51 can be increased or there may be a difference in the height (length) in the projecting direction. With this, the contact state of the contact convex portion 518 with the operation surface 31 can be detected in a plurality of steps when the pad portion 51 is hit. Therefore, it is possible to output sound more finely depending on the differences of the strength and the speed of the hit.

Figure 8:
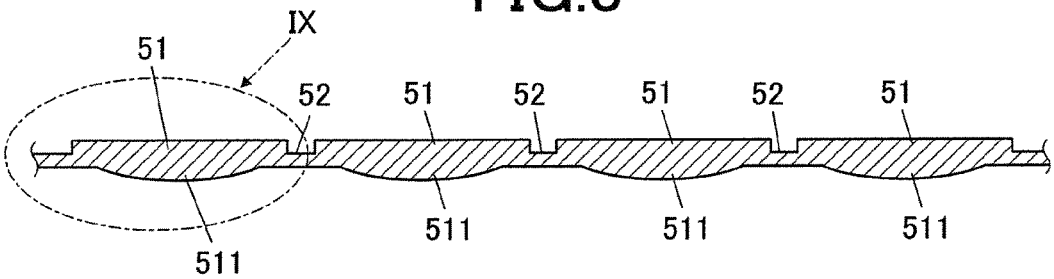
FIG. 8 is a schematic cross-sectional view of a pad sheet in which one contact convex portion is provided in a pad portion.
Figure 9A:
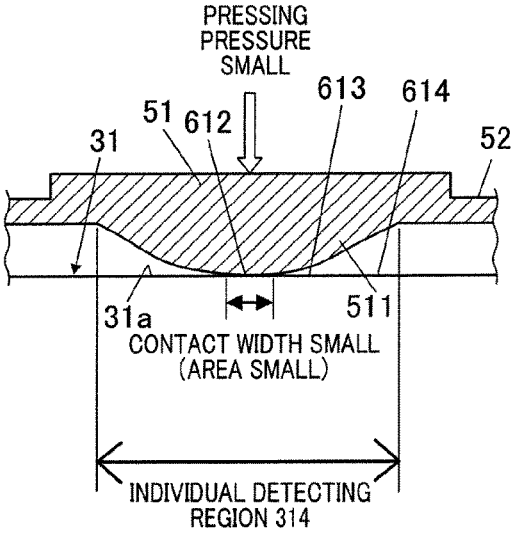
FIG. 9A is a cross-sectional view of a main section showing how the contact convex portion is deformed when the pad portion shown in FIG. 8 is pressed with a small force.
Figure 9B:
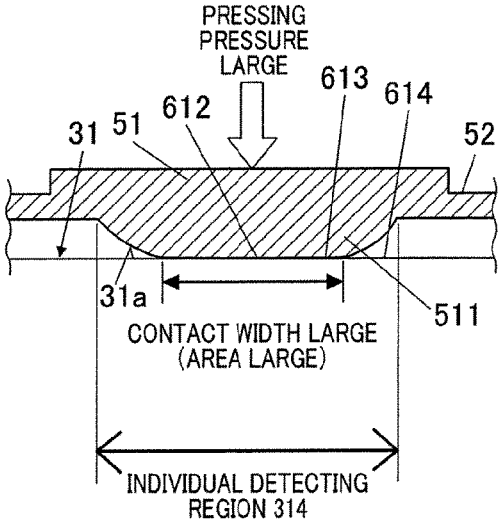
FIG. 9B is a cross-sectional view of a main section showing how the contact convex portion is deformed when the pad portion shown in FIG. 8 is pressed with a large force.

FIG. 8 is a cross-sectional view of a main section of the pad sheet showing aligning only four pad portions 51 including the contact convex portion 511 among the pad portions 51 shown in FIG. 4B. FIG. 9A and FIG. 9B are enlarged diagrams showing a region shown with IX in FIG. 8 (that is, region of one pad portion). FIG. 9A shows an example when the pressing force applied to the pad portion 51 is small, and FIG. 9B shows an example when the pressing force applied to the pad portion 51 is large.

As shown in FIG. 9A, when the pad portion 51 is pressed or hit with a small force ("pressing force small" in FIG. 9A), the sinking of the pad portion 51 is small, and the deforming amount of the contact convex portion 511 is small. Therefore, the contact width (contact square area) that the contact convex portion 511 contacts the operation surface 31 becomes small. In this case, the operation detector 31*a* of the operation surface 31 outputs the operation signal according to the position that the contact convex portion 511 contacted the operation surface (pad portion 51 corresponding to the contact convex portion 511) and the area that the contact convex portion 511 contacted the operation surface 31. Among the plurality of positions in the individual detecting region 314 in which contact can be detected, a center position 612, a position 613 slightly far from the center, and a position 614 further apart from the center are shown in FIG. 9A and FIG. 9B. When the pressing force is small, as shown in FIG. 9A, contact is made in only the position 612, and not in the position 613 and the position 614.

As shown in FIG. 9B, when the pad portion 51 is pressed or hit with a large force ("pressing force large" in FIG. 9B), the sinking of the pad portion 51 is large, and the deforming amount of the contact convex portion 511 is large. Therefore, the contact width (contact square area) that the contact convex portion 511 contacts the operation surface 31 becomes large. In this case, the operation detector 31*a* of the operation surface 31 outputs the operation signal according to the position that the contact convex portion 511 contacted the operation surface (pad portion 51 corresponding to the contact convex portion 511) and the area that the contact convex portion 511 contacted the operation surface 31. When the pressing force is large (close to the maximum detectable pressing force), as shown in FIG. 9B, contact is made in the position 612, and the position 613 (when contact is made to the position 614, the maximum pressing force is detected).

Figure 10:
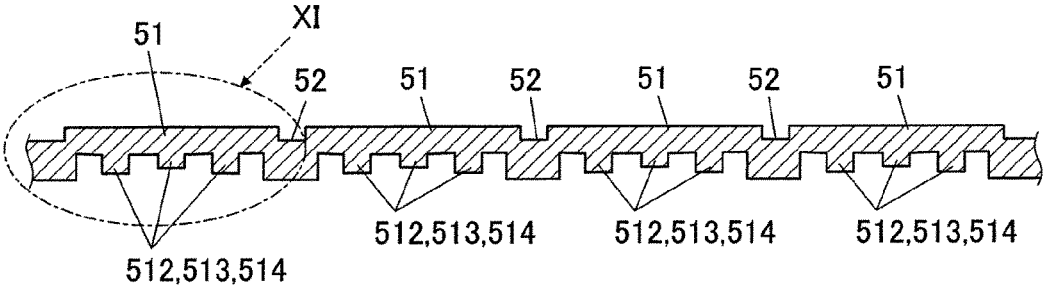
FIG. 10 is a schematic cross-sectional view of a pad sheet in which a plurality of contact convex portions are provided in the pad portion.
Figure 11A:
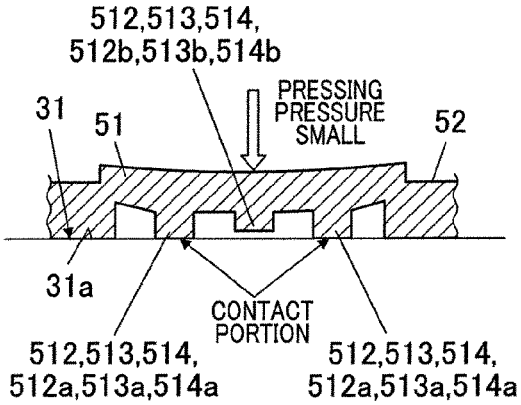
FIG. 11A is a cross-sectional view of a main section showing how the contact convex portion is deformed when the pad portion shown in FIG. 10 is pressed with a small force.

FIG. 10 is a cross-sectional view of a main section of the pad sheet showing aligning four pad portions 51 including any of the contact convex portions 512, 513, or 514 among the pad portions 51 shown in FIG. 4B. FIG. 11A and FIG.

Figure 11B:
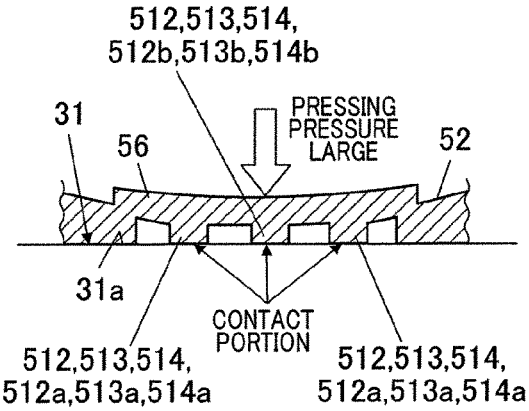
FIG. 11B is a cross-sectional view of a main section showing how the contact convex portion is deformed when the pad portion shown in FIG. 10 is pressed with a large force.

11B are enlarged diagrams showing a region shown with XI in FIG. 10 (that is, region of one pad portion). FIG. 11A shows an example when the pressing force applied to the pad portion 51 is small, and FIG. 11B shows an example when the pressing force applied to the pad portion 51 is large. FIG. 10, FIG. 11A, and FIG. 11B show an example in which the contact convex portions 512*b*, 513*b*, and 514*b* provided at substantially the center of the pad portion 51 have a height (length) in the projecting direction lower than the contact convex portions 512*a*, 513*a*, and 514*a* which are provided surrounding the contact convex portions 512*b*, 513*b*, and 514*b*.

As shown in FIG. 11A, when the pad portion 51 is pressed or hit with a small force ("pressing force small" in FIG. 11A), the sinking of the pad portion 51 is small, and the deforming amount of the contact convex portions 512, 513 and 514 is small. Therefore, regarding the contact convex portions 512, 513, and 514, only the contact convex portions 512*a*, 513*a*, and 514*a* with a high height (length) in the projecting direction contact the operation surface 31. In this case, the operation detector 31*a* of the operation surface 31 outputs the operation signal according to the position that the contact convex portions 512, 513, and 514 contacted the operation surface 31 (pad portion 51 corresponding to the contact convex portions 512, 513, and 514) and the number of contact convex portions 512*a*, 513*a*, and 514*a* among the contact convex portions 512, 513, and 514 that contacted the operation surface 31.

As shown in FIG. 11B, when the pad portion 51 is pressed or hit with a small force ("pressing force large" in FIG. 11B), the sinking of the pad portion 51 is large, and the deforming amount of the contact convex portions 512, 513 and 514 is large. Therefore, all of the contact convex portions 512, 513, and 514 including the contact convex portions 512*b*, 513*b*, and 514*b* with a low height (length) in the projecting direction contact the operation surface 31. In this case, the operation detector 31*a* of the operation surface 31 outputs the operation signal according to the position that the contact convex portions 512, 513, and 514 contacted the operation surface 31 (pad portion 51 corresponding to the contact convex portions 512, 513, and 514) and the total number of contact convex portions 512, 513, and 514 that contacted the operation surface 31.

The shape and the array of the contact convex portion are suitably determined according to the type of instrument that is simulated.

Figure 12A:
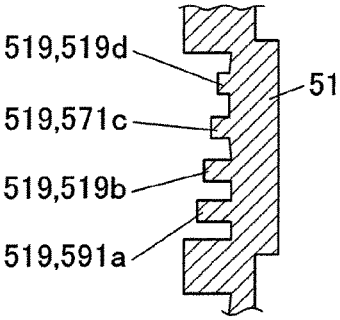
FIG. 12A is a cross-sectional view of a main section along a line XII-XII of the pad portion shown in FIG. 5.
Figure 12B:
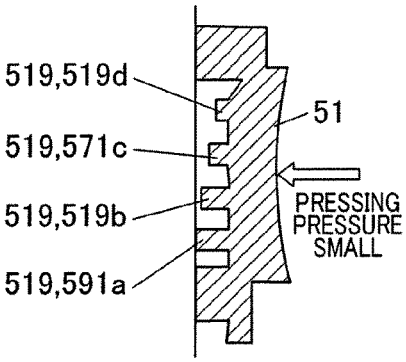
FIG. 12B is a cross-sectional view of a main section showing how the contact convex portion is deformed when the pad portion shown in FIG. 5 is pressed with a small force.
Figure 12C:
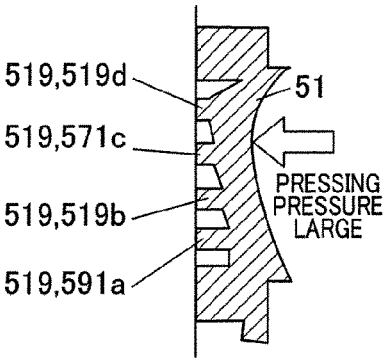
FIG. 12C is a cross-sectional view of a main section showing how the contact convex portion is deformed when the pad portion shown in FIG. 5 is pressed with a large force.

For example, FIG. 12A to FIG. 12C are cross-sectional views of the main section along line XII-XII in FIG. 5 and show a configuration of the pad portion 51 when the simulated instrument is a piano.

When playing the piano is simulated using the pad sheet 5, the pad portion 51 is configured as follows in order to make the feel close to hitting the keyboard of the piano. As shown in FIG. 12A to FIG. 12C, the pad portion 51 is a shape extending along the key of the piano. The base side of the key (that is, the side fixed to the piano chassis, the side far from the player) needs to be pressed with a larger force for the contact convex portion to contact the operation surface 31. The contact convex portion contacts the operation surface 31 with a weak force at the tip side of the key (that is, the side free from the piano chassis, the side close to the player).

For example, as shown in FIG. 12A to FIG. 12C, the contact convex portion 519 (contact convex portion 519*a* in FIG. 12A to FIG. 12C) with a high height (length) in the projecting direction is provided in the portion corresponding to the tip of the key in the pad portion 51 and the contact convex portion 519 (contact convex portion 519*d* in FIG. 12A to FIG. 12C) with a low height (length) in the projecting direction is provided in the portion corresponding to the base of the key in the pad portion 51. The easiness for the contact convex portion 519 to contact the operation surface 31 is adjusted in four steps.

With this, as shown in FIG. 12B, when the pad portion 51 is pressed or hit with a small force ("pressing force small" in FIG. 12B), the sinking of the pad portion 51 is small and the deforming amount of the contact convex portion 519 is small. Therefore, among the contact convex portions 519, only the contact convex portion 519*a* with the highest height (length) in the projecting direction contacts the operation surface 31. In this case, the operation detector 31*a* of the operation surface 31 outputs the operation signal according to the position of the contact convex portion 519*a* in contact with the operation surface 31 (pad portion 51 corresponding to the contact convex portion 519*a*) and the number of contact convex portions 519*a* in contact with the operation surface 31 among the contact convex portions 519.

As shown in FIG. 12C, when the pad portion 51 is pressed or hit with a large force ("pressing force large" in FIG. 12C), the sinking of the pad portion 51 is large and the deforming amount of the contact convex portion 519 is large. Therefore, all of the contact convex portions 519 contact the operation surface 31 including the contact convex portions 519*b* with the lowest height (length) in the projecting direction. In this case, the operation detector 31*a* of the operation surface 31 outputs the operation signal according to the position of the contact convex portion 519*a* in contact with the operation surface 31 (pad portion 51 corresponding to the contact convex portion 519*a*) and the total number of contact convex portions 519 in contact with the operation surface 31.

The control apparatus 33 which received the operation signal from the operation detector 31*a* determines which type of sound (scale and type of instrument) is output from the position of the contact convex portion (pad portion 51 corresponding to the contact convex portion).

That is, as described above, a function such as scale or type of instrument is applied to each pad portion 51, and the association between the pad portions 51 and the functions are defined in the application program. The control apparatus 33 is able to determine which type of sound is output by referring to such association.

According to the present embodiment, the control apparatus 33 determines the strength (velocity) that the sound is output (sound is emitted) according to the contact state of the pad portion 51 on the operation surface 31 corresponding to the operation signal and outputs (emits the sound) the corresponding sound of the sound source at the strength (velocity) corresponding to the operation signal.

That is, the pad portion 51 according to the present embodiment changes the contact state on the operation surface 31 depending on the external force when the external force is applied, and the operation detector 31*a* outputs the operation signal according to the contact state. The contact state of the pad portion 51 on the operation surface 31 changes depending on the strength and speed (energy) of the force by pressing or hitting the pad portion 51, and according to the present embodiment, the contact state is the range of the contact portion, the number of contact portions and the contact timing that the pad portion 51 (contact convex portion of the pad portion 51 in the present embodiment) contacts the operation surface 31.

When the strength or the speed (energy) of the force by the pushing and hitting is strong, as the change in the pad portion 51, the range of the contact portion and the number of contact portions that the pad portion 51 (contact convex portion of the pad portion 51) contacts the operation surface 31 becomes large according to the strength and energy of the force.

Therefore, when the range of the contact portion or the number of contact portions that the pad portion 51 (contact convex portion of the pad portion 51) contacts the operation surface 31 is large, the control apparatus 33 determines that the pad portion 51 is hit strongly and emits a large sound.

On the other hand, when the range of the contact portion or the number of contact portions that the pad portion 51 (contact convex portion of the pad portion 51) contacts the operation surface 31 is small, the control apparatus 33 determines that the pad portion 51 is hit weakly and emits a small sound.

When the range of the contact portion or the number of contact portions that the pad portion 51 (contact convex portion of pad portion 51) contacts the operation surface 31 gradually increases over time, the control apparatus 33 determines that a weak force is gradually applied (contact timing is late) and may control output of the sound so that the output sound starts from a small sound and gradually becomes larger.

Preferably, a step portion with a height different from the pad portion 51 is formed on the front surface side (upper side in FIG. 2) opposite of the surface that the pad portion 51 and the operation surface 31 face each other.

For example, in FIG. 1 and FIG. 2, only the pad portion 51 on the front surface side (upper side in FIG. 2) in the pad sheet 5 is projected upward to be high, and the portions other than the pad portion 51 is to be a step portion 52 with a height lower than the above.

By providing such step portion 52, the player (user) is able to understand the position of the pad portion 51 by only touching the surface of the pad sheet 5.

Therefore, since the player knows the position to be hit (pushed) without looking at the pad sheet 5 while playing, the player is able to hit the pad sheet 5 in a way similar to playing a normal instrument, that is, playing with the feel of the finger while looking at musical scores.

Different from the height of the pad portion 51, the step portion 52 is for understanding the position of the pad portion 51 by touch. Therefore, the present invention is not limited to the above examples. For example, a groove can be provided as the step portion 52 surrounding the pad portion 51, or a standing portion can be provided standing higher above the pad portion 51 surrounding the pad portion 51 as the step portion 52.

«Effect of Pad Sheet and Operation Input System Including Pad Sheet»

Next the effect of the pad sheet and the operation input system including such pad sheet according to the present embodiment is described with reference to FIG. 13.

Figure 13:
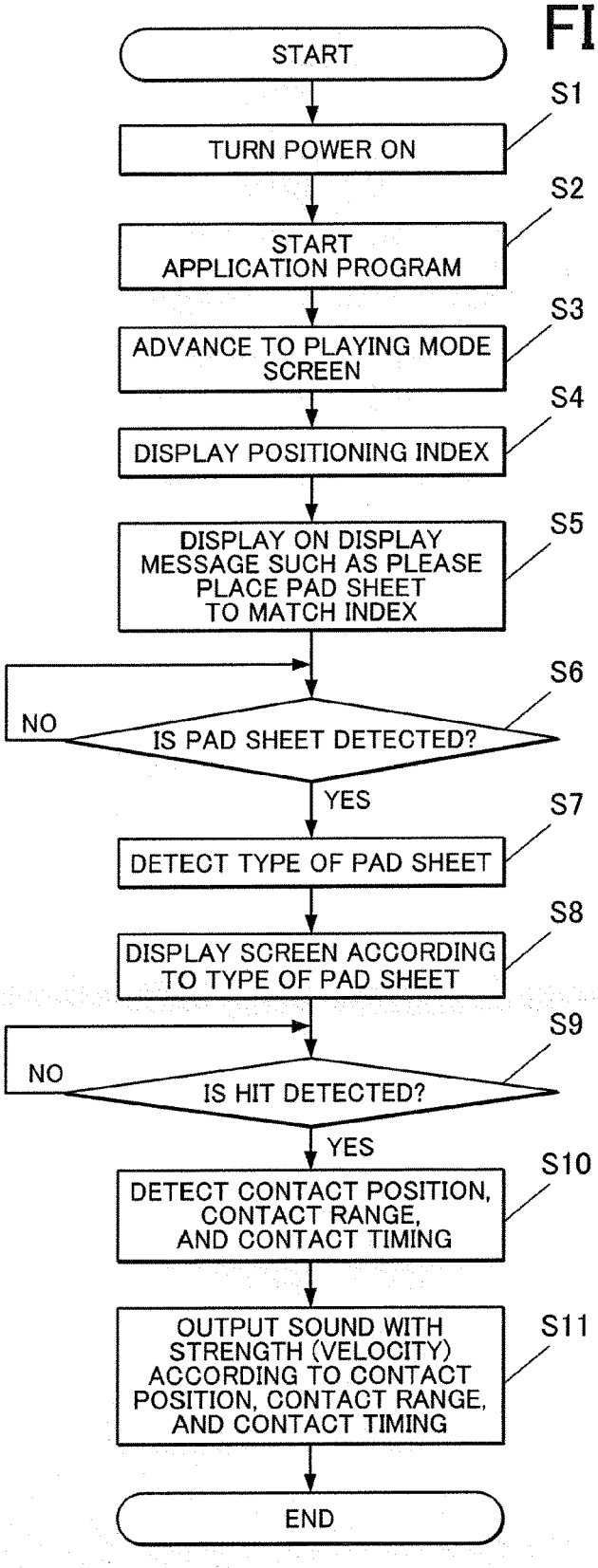
FIG. 13 is a flowchart showing a process by an operation input system according to the present embodiment.

As shown in FIG. 13, when the power source of the electronic device 3 included in the operation input system 1 is turned ON (step S1), the control apparatus 33 (CPU 711) starts the application program to execute the simulation playing mode in response to the user selection operation (step S2). Next, the control apparatus 33 changes the display of the operation surface 31 of the electronic device 3 to the playing mode screen (for example, see FIG. 3) (step S3). In such playing mode screen, the control device 33 displays the positioning index 312 which instructs the position to provide the pad sheet 5 on the screen (step S4). Then, the control device 33 displays on the operation surface 31 a message to urge the user to provide the pad sheet 5 on the operation surface 31 to match with the positioning index 312 (step S5). Here, together with the display of the message or instead of the display of the message, guidance by voice can be emitted to provide the pad sheet 5 on the operation surface 31 to match with the positioning index 312.

The control apparatus 33 determines whether it is detected that the pad sheet 5 is provided on the operation surface 31 based on the detection information from the operation detector 31*a* (step S6). When the placement of the pad sheet 5 is not detected (step S6; NO), the control apparatus 33 repeats the determination in step S6.

When the placement of the pad sheet 5 is detected (step S6; YES), the control apparatus 33 detects the type of pad sheet 5 (step S7). For example, convex portions can be provided in a number and shape according to the type of pad sheet 5 in the position which can be detected by the operation detector 31*a*, excluding the pad portion 51. This is detected by the operation detector 31*a* and acknowledged by the control apparatus 33. The method to detect the type of pad sheet 5 is not limited to the above, and for example, the user makes an input with the operation button 311 on the operation surface 31 or makes a selection from the options so that the control apparatus 33 is able to acknowledge the type of pad sheet 5. In this case, a message such as please select the type of pad sheet used can be displayed on the operation surface 31 to urge the user to make an input.

When the control apparatus 33 detects the type of pad sheet 5 (step S7), the control apparatus 33 displays the screen according to the type of pad sheet 5 on the operation surface 31 (step S8). The screen according to the type of pad sheet 5 is a display of a pad index 313 such as a frame corresponding to the pad portion 51 or a character or a figure corresponding to the pad portion 51 in the position corresponding to the pad portion 51 when the pad sheet 5 is provided on the operation surface 31. In the playing mode, it is not necessary to display the screen according to the type of pad sheet 5. For example, when the transparency of the pad sheet 5 is low and the contents displayed on the operation surface 31 cannot be read with the pad sheet 5 overlapped, the screen according to the type of pad sheet 5 does not have to be displayed. Whether to display such screen can be selected by the user making an input with the operation button 311.

From the start of the playing mode, the control apparatus 33 always determines whether the hit (press, etc.) to the pad portion 51 is detected, that is, whether the operation signal showing the contact state of any pad portion 51 to the operation surface 31 is input from the operation detector 31*a* (step S9). When the hit (press, etc.) to the pad portion 51 is not detected (step S9; NO), the determination of step S8 is repeated.

When the hit (press, etc.) to the pad portion 51 is detected (step S9; YES), the control apparatus 33 detects the contact state such as contact position, range of the contact portion, number of contact portions and contact timing that the pad portion 51 (contact convex portion 511 of the pad portion 51) contacts the individual detecting region 314 corresponding to the pad portion 51 provided on the operation surface 31 based on the operation signal output from the operation detector 31*a* (step S10). Then, the control apparatus 33 outputs from the speaker or audio terminal (not shown) the sound with the strength (velocity) according to the contact state such as the contact position, range of the contact portion, number of contact portions, and the contact timing detected above (step S11).

For example, the control apparatus 33 specifies the position farthest from the center of the individual detecting region 314 from the plurality of positions in which contact in the individual detecting region 314 is detected. When the distance from the center to the specified position is 2 mm or less, the strength of the operation is determined to correspond to the force of 100 g or less. Similarly, when the distance is 2 to 4 mm, the force is 100 to 200 g, when the distance is 4 to 6 mm, the distance is 200 to 500 g, and when the distance is 6 to 8 mm, the force is 500 to 1000 g. The control apparatus 33 sequentially specifies the position farthest from the center of the individual detecting region 314 among the plurality of positions in which contact is detected in the individual detecting regions 314, and when the changing speed of the distance from the center to the sequentially specified position is 1 m/s, it is determined that the speed is 1 m/s. Similarly, 2 m/s is determined to be 4 m/s, and 3 m/s is determined to be 8 m/s. The relation of increase in force of the operation according to the detected distance can be a linear increase, and can be an exponential increase. The same can be said for the relation of increase in the speed of operation according to the changing speed of the detected distance.

Then, the control apparatus 33 determines the strength (volume) of the emitted sound according to the detected strength or the detected speed of operation as described above (refers to the conversion table in which the relation that the stronger or faster the operation is, the sound is larger is determined in advance and converts to the velocity in the MIDI signal, etc.).

With this, the user is able to provide the pad sheet 5 on the electronic device 3 such as a portable terminal apparatus including the operation surface 31 which is a touch panel, and the user is able to enjoy playing a simple simulated instrument by merely hitting and pressing the pad portion 51 with the user's fingers.

«Effect of Pad Sheet and Operation Input System Provided with Such Pad Sheet»

As described above, according to the present embodiment, the pad sheet 5 is used attached to the electronic device 3 including an operation surface 31 which is a touch panel and an operation detector 31*a* which can output the operation signal according to whether there is contact to the operation surface 31 and the contact range. The pad sheet 5 can be deformed. The pad sheet 5 includes a pad portion 51 provided on the operation surface 31. When external force is applied to the pad portion 51, the contact state of the pad portion 51 to the operation surface 31 can be changed according to the strength of the external force.

The pad sheet 5 according to the present embodiment is not provided with electrodes or circuits, and can be manufactured cheaply from resin, etc.

The pad sheet 5 according to the present embodiment can be widely applied to typical electronic devices provided with a touch panel. Normally, the strength and the speed of the hit cannot be detected by only the touch panel. The deforming of the pad portion 51 is converted to change in the contact range of the operation surface 31 so that the above can be detected. Then, similar to playing an actual instrument, the sound with the strength (velocity) according to the user's operation of hitting (pressing) the pad portion 51 can be output from the typical electronic device.

With this, anyone can easily enjoy playing a simulated instrument similar to playing an acoustic instrument by using a typical electronic device such as a normal smartphone which is not an electronic instrument customized for a certain use.

According to the present embodiment when the positioning index 312 is provided, the positioning index 312 is used as a target when the pad sheet 5 is attached to the electronic device 3. With this, it is possible to surely overlap the region on the pad sheet 5 with which the contact state to the operation surface 31 changes by providing the pad portion 51 with the region on the operation surface 31 in which the operation detector 31*a* detects the contact state to the operation surface 31.

According to the above, when the pad portion 51 of the pad sheet 5 attached to the electronic device 3 is hit or pressed, the contact state can be surely detected by the operation detector 31*a*, and it is possible to perform the output desired by the user.

According to the present embodiment, the contact state of the pad portion 51 to the operation surface 31 includes the range of the contact portion, the number of contact portions and the contact timing regarding the pad portion 51 in contact with the operation surface 31.

The range of the contact portion, the number of contact portions, and the contact timing can be easily detected by the operation detector 31*a* included in the normal touch panel, and according to the present embodiment, the index specific to the instrument when the sound is output such as strength and speed of the hit can be detected by replacing the above with the contact state.

With this, as long as the typical electronic device such as the smartphone is provided with a normal touch panel, anyone can easily enjoy playing the simulated instrument using the typical electronic device.

According to the present embodiment, the plurality of pad portions 51 are provided so that the position and the size of the plurality of regions (individual detecting region) on the operation surface 31 with which the operation detector 31*a* can individually detect the contact state correspond to the position and the size of the plurality of regions on the pad sheet 5 in which the plurality of pad portions 51 are provided and the contact state to the operation surface 31 changes individually.

With this, the contact state of each pad portion 51 to the operation surface 31 can be suitably detected by the operation detector 31*a* and it is possible to output the sound desired by the user.

According to the present embodiment, the plurality of pad portions 51 in which the contact state to the operation surface 31 changes individually are provided on the pad sheet 5, and the operation detector 31*a* is able to include an adjustment to correspond the position of the plurality of regions (individual detecting regions) on the operation surface 31 which can individually detect the contact state to the position of the plurality of pad portions 51 on the pad sheet 5 positioned on the operation surface 31.

In such example, even when the positioning index 312 is not displayed on the operation surface 31 or when the user provides the pad sheet 5 ignoring the positioning index 312, the operation detector 31*a* is able to surely detect the contact state of the pad portion 51 to the operation surface 31 and playing can be easily enjoyed.

According to the present embodiment, the pad portion 51 includes the contact convex portion 511 on the contact side with the operation surface 31, and the contact state of the contact convex portion 511 to the operation surface 31 changes according to the strength of the external force when the external force is applied to the pad portion 51.

With this, the external force (hitting force and pressing force) applied to the pad portion can be transmitted to the operation detector 31*a* of the operation surface 31 through the contact convex portion 511. By changing the shape and the arrangement of the contact convex portion 511 according to the type of instrument simulated (that is, for example, according to the shape of the operating handle of the instrument or the features of applying force during playing of the instrument), the contact state can be adjusted (range of the contact portion, number of contact portions and the contact timing, that the pad portion 51 contacts the operation surface 31) and the output of the sound can be controlled so that the output sound is suitable for the simulated instrument.

According to the present embodiment, a plurality of contact convex portions 512, 513, 514 are provided on the pad portions 51, and as the external force applied to the pad portion 51 becomes stronger, the number of contact convex portions 512, 513, 514 which contact the operation surface 31 increases.

Therefore, the operation detector 31*a* can easily detect the strength of the force to press or hit the pad portion 51 by detecting the number of contact convex portions 512, 513, 514 which contact the operation surface 31. With this, similar to playing the actual instrument, the sound with the strength (velocity) according to the hitting operation (pressing) performed by the user on the pad portion 51 can be output.

According to the present embodiment, on the front surface side opposite to the surface that the pad portion 51 faces the operation surface 31, a step portion 52 with a height different from the pad portion 51 is formed.

When the pad, etc. which is the target of hitting when playing the instrument is displayed on the normal touch panel of the electronic device, the position of the pad needs to be confirmed by sight, and the user needs to look at the display screen while playing.

By providing the pad sheet 5 according to the present embodiment on the operation surface 31 of the electronic device, the user is able to acknowledge the position of the pad portion 51 only by touch without looking at the pad portion 51. With this, similar to playing the actual instrument, the user is able to play the simulated instrument without looking at the fingers and while looking at musical scores.

According to the present embodiment, the operation surface 31 of the electronic device 3 is a pressure sensitive (resistive film) touch panel.

Therefore, the operation on the operation surface 31 can be detected only by applying pressure from outside, and there is no limit to the material which form the pad sheet 5 provided on the operation surface 31. Therefore, the material to form the pad sheet 5 can be selected freely, and the pad sheet 5 can be manufactured with the desired feel and hardness.

«Modification»

An embodiment of the present invention is described, but the present invention is not limited to the above embodiments, and various modifications are possible without leaving the scope of the present invention.

For example, according to the present embodiment, the pad sheet 5 is simply placed on the operation surface 31 of the electronic device 3, but the shape and the configuration of the pad sheet 5 is not limited to the above.

For example, a vertical descending portion descending toward the electronic device 3 which is where the pad sheet 5 is attached can be provided on an external edge of the pad sheet 5. When the pad sheet 5 is placed on the operation surface 31 of the electronic device 3, the vertically descending portion can cover the side of the casing of the electronic device 3.

When such vertically descending portion is provided, it is possible to prevent the position of the pad sheet 5 shifting and the pad sheet 5 coming off of the operation surface 31.

In order to prevent the pad sheet 5 shifting or coming off of the operation surface 31 while repeating the hitting, it is possible to separately provide a latching member in a band shape to latch the pad sheet 5 to the electronic device 3.

According to FIG. 1, the pad sheet 5 is smaller than the operation surface 31 of the electronic device 3 and is placed on only a portion of the operation surface 31. However, the size and the shape of the pad sheet 5 are not limited to the illustrated examples, and the entire operation surface 31 can be covered. In this case, a larger space can be used as the space for playing the simulated instrument.

The pad sheet 5 can be formed largely so that the pad sheet 5 can be applied to a plurality of electronic devices 3 with different sizes, and only a portion of the pad sheet 5 can be used when the pad sheet 5 is applied to the small electronic device 3.

In this case, an index showing the major default sizes of portable terminal apparatuses and tablet terminal apparatuses can be provided on the pad sheet 5. With this, preferably, when the pad sheet 5 is applied to the small electronic device 3, the pad sheet 5 is provided in the suitable position by matching the index corresponding to the electronic device 3 to be used to four corners of the electronic device 3.

What is claimed is:

1. An operation state detecting apparatus comprising:

an electronic device which includes an operation surface and which can detect whether there is contact by operation in a plurality of positions on the operation surface; and a sheet material which can be attached to and detached from the operation surface of the electronic device, wherein, the sheet material includes a plurality of projecting portions, each of the projecting portions deforms to change a contact state on the operation surface according to strength of external force applied to each of the projecting portions in a state with the sheet material attached to the operation surface, and a processor of the electronic device sets a plurality of detecting regions on the operation surface such that the contact states of each of the detecting regions are respectively changed by deforming of each of the projecting portions in a state with the sheet material attached to the operation surface, and detects whether there is contact with one of the projecting portions to which external force is applied at each of a plurality of positions in one of the detecting regions corresponding to the one of the projecting portions on the operation surface, and the processor performs a specific process according to strength or speed of an operation applied to the one of the projecting portions judged based on a detected result indicating a number of the contact positions or a size of area including the contact positions in the one of the detecting regions.

2. The operation state detecting apparatus according to claim 1, wherein, the operation surface is a general-purpose operation surface that can detect an operation at any position, and the operation surface has a general-purpose display surface that can be displayed at any position, and the processor dynamically sets the plurality of individual detecting regions correspond to the plurality of projecting portions and dynamically display a mark correspond to the sheet material when the sheet material attached to the operation surface, and the processor of the electronic device judges the strength and the speed of the operation applied to the one of the projecting portions based on the detected result in the one of the detecting regions.

3. The operation state detecting apparatus according to claim 2, wherein, when one of a plurality types of the sheet material is selected as the sheet material attached to the operation surface, the processor sets a plurality of detecting regions such that the position of the plurality of detecting regions provided on the operation surface to match with the positions of the plurality of projecting portions of the selected sheet material.

4. The operation state detecting apparatus according to claim 2, wherein the operation surface has a display surface, and the processor display a placemark on the display surface to align the positions of the plurality of projecting portions provided on the sheet material with the positions of the plurality of individual detecting regions provided on the operation surface when the sheet material is attached to the operation surface.

5. The operation state detecting apparatus according to claim 1, wherein the processor sets the plurality of detecting regions such that each position and size of the plurality of detecting regions corresponding to each position and size of the plurality of projecting portions.

6. The operation state detecting apparatus according to claim 1, wherein a change in the contact state includes at least one of the following changes, a size of area including the contact positions in the one of the detecting regions, a number of contact portions in the one of the detecting regions and contact timing that the projecting portion contacts in the one of the detecting regions.

7. The operation state detecting apparatus according to claim 1, wherein a change in the contact state is a change in timing that the projecting portion contacts each of the plurality of positions in the one of the detecting regions, and the processor judged the speed of the operation applied to the projecting portion according to a difference of contact timing between a plurality of positions in the one of the detecting regions.

8. The operation state detecting apparatus according to claim 1, wherein the operation surface is a pressure sensitive touch panel.

9. An electronic instrument comprising:

the operation state detecting apparatus according to claim 1, wherein the electronic device controls output of sound according to the strength or the speed of the operation on the operation surface detected by the individual detecting region.

10. The electronic instrument according to claim 9, wherein the electronic device controls strength of the output sound according to the strength or the speed of the operation on the operation surface detected by the individual detecting region.

11. The electronic instrument according to claim 9, wherein, the sheet member includes a plurality of projecting portions with different shapes, and the electronic device controls the sound to output the sound with a different tone according to the individual detecting region in which the operation is detected from among the plurality of individual detecting regions corresponding to the plurality of projecting portions.

12. The electronic instrument according to claim 11, wherein the electronic device controls the sound to output the sound of different types of instruments according to the individual detecting region in which the operation is detected from among the plurality of individual detecting regions.

* * * * *